US005762007A

United States Patent [19]

Vatsky

[11] Patent Number: 5,762,007

[45] Date of Patent: Jun. 9, 1998

[54] FUEL INJECTOR FOR USE IN A FURNACE

[76] Inventor: Joel Vatsky, 313 Potomac Dr., Basking Ridge, N.J. 07920

[21] Appl. No.: 771,965

[22] Filed: Dec. 23, 1996

[51] Int. Cl.[6] ..... F23D 1/02

[52] U.S. Cl. ..... 110/264; 110/263; 110/104 B; 431/182; 431/183; 431/187

[58] Field of Search ..... 110/261, 264, 110/104 B, 263; 431/181, 182, 183, 187

[56] References Cited

U.S. PATENT DOCUMENTS

| | | | |
|---|---|---|---|
| 3,584,786 | 6/1971 | Johnson | 239/597 |
| 3,687,375 | 8/1972 | Griffiths | 239/557 |
| 3,997,287 | 12/1976 | Schutte | 431/355 |
| 4,223,615 | 9/1980 | Breen et al. | 110/264 |
| 4,348,170 | 9/1982 | Vatsky et al. | 431/188 |
| 4,686,957 | 8/1987 | Koziol | 126/41 R |
| 4,827,889 | 5/1989 | Ray | 123/557 |
| 4,930,430 | 6/1990 | Allen et al. | 110/264 |
| 4,989,549 | 2/1991 | Korenberg | 122/149 |
| 5,061,457 | 10/1991 | Hsieh et al. | 422/140 |
| 5,156,100 | 10/1992 | Pentti | 110/347 |
| 5,163,830 | 11/1992 | Pfefferkorn | 431/355 |
| 5,240,409 | 8/1993 | Xiong | 431/189 |
| 5,292,244 | 3/1994 | Xiong | 431/189 |
| 5,324,195 | 6/1994 | Sigler | 431/286 |
| 5,347,937 | 9/1994 | Vatsky | 110/261 |
| 5,388,536 | 2/1995 | Chung | 110/264 |
| 5,408,943 | 4/1995 | Vatsky | 110/261 |
| 5,431,114 | 7/1995 | Morita et al. | 110/265 |
| 5,445,519 | 8/1995 | Sigler | 431/286 |
| 5,483,906 | 1/1996 | Hufton | 110/260 |
| 5,529,000 | 6/1996 | Hartel et al. | 110/347 |
| 5,540,583 | 7/1996 | Keller et al. | 431/8 |

*Primary Examiner*—Henry A. Bennett
*Assistant Examiner*—Pamela A. O'Connor
*Attorney, Agent, or Firm*—Lerner, David, Littenberg, Krumholz & Mentlik

[57] ABSTRACT

A fuel injector for use in a furnace is provided. The fuel injector may include a generally tapered configuration and a nozzle having a plurality of open sections, which preferably have an elliptical configuration, arranged at the output for providing rich segregated fuel streams.

33 Claims, 4 Drawing Sheets

FUEL INJECTOR FOR USE IN A FURNACE

FIELD OF THE INVENTION

The present invention relates to an improved fuel injector for use in connection with a furnace. More particularly, the present invention relates to a fuel injector and a furnace where pulverized fuel is efficiently burned so that the formation of nitrogen oxides are reduced.

BACKGROUND OF THE INVENTION

Great efforts have been exerted by prior art inventors to produce a fuel injector, and components thereof, in which pulverized coal is transported for combustion in an associated furnace and in which, at the same time, the quantity of nitrogen oxides produced as by-products is minimized. Notwithstanding these great efforts which have been exerted in this field, prior art fuel injectors still have a number of significant shortcomings.

Prior art burner assemblies which produce small amounts of nitrogen oxides as by-products are typically known as low $NO_x$, burner assemblies. In known low $NO_x$, burner assemblies, secondary air (i.e., air which flows outside of the fuel injector) is introduced into the system through a secondary air register. The secondary air register typically includes a single throat or a dual throat design. Single throat designs use a single set of vanes or dampers to control air swirl or flow while dual throat designs use two sets of vanes or dampers to control air swirl or flow.

Primary air is most commonly used as the carrier gas and is introduced into the fuel injector for transporting pulverized coal, or other pulverized fuel, to the furnace for combustion. The fuel injector may be centrally arranged within the secondary air register along the central line of the burner system.

Various types of inlets have been used to feed pulverized fuel and primary air into fuel injectors. Such inlets include scrolls, elbows and various ninety degree turning heads. These inlets generally have two purposes. First, to transport the mixture of primary air and pulverized coal from pipes which may be located vertically from the burner front to the fuel injector which is usually oriented in a horizontal plane facing the furnace. Inlets are also used to break-up concentrated pulverized coal streams (also known as "ropes") which tend to form as a stream of pulverized coal is forced to make a ninety degree turn upon entering the fuel injector so that a more uniform mixture of pulverized coal and primary air is obtained at the fuel injector nozzle.

The nozzle of fuel injectors generally includes the portion of the fuel injector where the pulverized coal and primary air exit adjacent to the combustion chamber of the furnace. Various low $NO_x$ nozzles have been used in prior art fuel injectors. Examples of prior art nozzles and fuel injector designs are disclosed in U.S. Pat. Nos. 5,408,943; 5,347,937 and 4,348,170 all of which identify Vatsky, the inventor of the present invention, as an inventor or a co-inventor thereof. While the design of the fuel injectors, including the nozzles, disclosed in the aforementioned patents are useful in certain applications, they include split-stream designs (i.e., split-flame designs) or toothed stabilized designs, which place various surfaces in the path of the pulverized coal stream. Such surfaces may include cones, ports, vanes and plate segments.

Prior art fuel injector and burner designs are subject to various problems such as erosion, thermal distortion, warping, coal adhesion and coking. Coking within annular fuel injector assemblies is typically caused by coal layout on top of the inner barrel or the bottom of the outer barrel of the fuel injector. Coking inside of the fuel injector nozzle may result due to turbulent eddy zones caused by the split-stream, cones, ports, vanes or plate segments which cause coal adhesion to the metal surfaces.

High pressure drop within prior art fuel injector assemblies has also previously been a problem. Such high pressure drop zones within fuel injector assemblies are typically caused by excessive resistance in the inlet scroll due to turbulence which results from the high rotational rate of a mixture of primary air and pulverized coal. Further, turbulence that results from eddy zones and recirculation zones in conventional split-stream type of nozzles also results in unwanted excessive pressure drops across the nozzles.

Another problem associated with prior art fuel injectors is unbalanced fuel distribution at the outlet of prior art fuel injector nozzles. This problem is particularly caused by pulverized coal which separates from the primary air carrier inside of the inlet prior to entering the horizontal section of the fuel injector. As indicated above, such inlet devices may be a scroll device, an elbow device or a ninety degree turning head. This results in "roping" of the coal in the fuel injector. The distribution of the "rope" within the fuel injector downstream of the inlet has been a congenital problem with burner assembly designs.

The foregoing shortcomings of prior art fuel injectors as well as other shortcomings are resolved by the present fuel injector design which particularly eliminates coking, reduces pressure drop and eliminates roping problems.

Nitrous oxide emissions are formed from two primary sources: nitrogen, which is chemically bound in the fuel, such as coal, which is known as "fuel $NO_x$"; and high temperature fixation of atmospheric nitrogen contained in the combustion air, which is known as "thermal $NO_x$". The formation of both fuel and thermal $NO_x$ is governed by the availability of oxygen in the early phase of combustion. In this regard, when too much oxygen is available in the early combustion phases, a high $NO_x$ output will result. Thermal $NO_x$ is directly and exponentially dependent on temperature. As the combustion temperature increases, the $NO_x$ output exponentially increases. Adjusting the distribution of air and fuel at the nozzle of the fuel injector (i.e., at the entrance to the furnace combustion chamber) such that the initial combustion occurs under very rich fuel conditions will significantly decrease the conversion of fuel-based nitrogen to nitrous oxide. The same rich fuel conditions will also decrease the flame temperature which will also significantly reduce the formation of thermal $NO_x$.

Rich fuel conditions for the initial phase of combustion can be attained by "staging" both the secondary air and the fuel. The former is achieved by utilizing low turbulence secondary air registers which prevent rapid mixing of the secondary air with the stream of pulverized coal and primary air. Staging of the fuel is achieved by either concentrating the fuel into several streams as it exits the nozzle of the fuel injector, or by concentrating the fuel along the axis of the fuel injector as it exits the nozzle. It is known that split or segregated streams that form split flames result in low $NO_x$ outputs with particularly stable and controllable flames.

SUMMARY AND OBJECTS OF THE INVENTION

The present invention particularly overcomes the various shortcomings of prior art fuel injectors by providing a novel and unobvious low $NO_x$ fuel injector design due to an extremely efficient combustion of pulverized coal.

As used herein, the term "fuel injector" is intended to cover devices used to transport pulverized fuel and a carrier gas to be burned within an associated furnace. It should be appreciated that the term "pulverized fuel" is intended to cover various types of fuel such as pulverized coal and the like. However, the term "pulverized coal" may be used for convenience and is intended to encompass various types of pulverized fuels other than coal. Further, the term "carrier gas" includes gases other than air. However, since air is used to transport the pulverized coal in accordance with a preferred embodiment of the present invention, the term "primary air" will often be used herein and is intended to encompass various types of carrier gases other than air.

The design of the fuel injector of the present invention has been developed to enhance the performance and reliability of low $NO_x$ burners. It should be appreciated that the design concepts are applicable to various types of low $NO_x$ burner systems, and are particularly beneficial for use in burner systems having scroll-type inlets and split-flame nozzle tips.

In accordance with the preferred embodiment of the present invention, a fuel injector is provided for use in a furnace. The fuel injector comprises an elongated inner barrel and an elongated outer barrel having a proximal inlet end and a distal outlet end. The outer barrel extends coaxially with and circumferentially surrounds the inner barrel between the inlet and outlet ends so that an elongated passageway is formed between the external surface of the inner barrel and the inner wall of the outer barrel. This passageway is adapted to accommodate the flow of pulverized fuel and a carrier gas therein. Preferably, the pulverized fuel will comprise pulverized coal and the carrier gas will comprise air, referred to herein as primary air. The outlet end of the outer barrel includes a nozzle having a plurality of open sections. Preferably, each of the open sections have an elliptical configuration. For ease of reference, the open sections will be hereinafter described as "elliptical sections." However, it should be understood that the open sections of the nozzle of the present invention may have various geometric configurations such as semi-circular, triangular, rectangular, irregular or any other shape. Each of the elliptical sections being open along a side thereof for continuous communication with the passageway The construction of the fuel injector is such that the pulverized fuel and the carrier gas introduced into the passageway at the inlet end of the outer barrel proceeds substantially unobstructed without encountering any barrier and are forced to exit the fuel injector through the elliptical sections of the nozzle so that separated fuel streams are obtained. These fuel streams may be particularly rich and are thus ideal for combustion purposes.

Preferably, the outer barrel comprises a transition region arranged between the inlet and outlet ends thereof. The transition region is preferably tapered to decrease the diameter of the outer barrel as it extends between the inlet and outlet ends whereby the velocity at which the pulverized fuel and the carrier gas flows within the passageway is increased within the transition region.

The nozzle of the present fuel injector preferably comprises an inner surface and an outer surface. Secondary or straightening vane means may be provided at the outer surface of the distal portion of the outlet end of the nozzle for preventing rotational components of secondary air flow adjacent the outer surface of the nozzle from prematurely forcing the separated fuel streams from merging together. The outer surface of the nozzle may also have convex sections which forms peaks and valleys associated with corresponding elliptical sections. Stabilizer vane means may be arranged at the peaks for maintaining each of the separated fuel streams close to the nozzle.

In another preferred embodiment of the present invention, a deflector shield may be provided which at least partially surrounds the inner barrel between the inlet and outlet ends of the outer barrel. In a particularly preferred embodiment, the deflector shield may be cylindrical and is arranged at the distal end of the transition region. The deflector shield is particularly effective at protecting the inner barrel from wear due to the impact of pulverized fuel particles. Further, the deflector shield serves the function of spreading out impacting pulverized fuel so that a substantially uniform flow of the pulverized fuel is obtained as it exits the nozzle.

It is also preferable for the transition region to comprise an inner surface having a smoothly tapered configuration which minimizes turbulence of pulverized fuel and carrier gas flow. This configuration may have an s-shape and is preferably free from abrupt diametrical changes along the surface thereof.

It is also preferable for the outer barrel of the present fuel injector to include a relatively large diameter at the inlet end and a relatively small diameter at the outlet end. In this preferred embodiment, the transition region is preferably tapered to provide a substantially uniform reduction in diameter so that the velocity of the pulverized fuel and primary air flowing within the passageway between the exterior surface of the inner barrel and the internal surface of the outer barrel is substantially increased. In this preferred embodiment, it is also preferable for the transition region to be tapered to such a degree so that a relatively low pressure drop is obtained with respect to the pulverized fuel and carrier gas flowing therethrough.

It is also preferable for the nozzle of the present fuel injector to be tapered from its proximal end where it has a relatively large diameter to its distal end where it has a relatively small diameter. As discussed above, it is preferable for the distal end of the nozzle to include a plurality of elliptical sections so that segregated rich streams of pulverized coal are formed as the primary air and pulverized coal exists the nozzle.

In another preferred embodiment, the transition region of the outer barrel includes a plurality of elongated primary air straightening vanes arranged on the inner side thereof for preventing rotation of pulverized fuel and primary air flow about the inner barrel. In a particularly preferred embodiment, six primary air straightening vanes may be equidistantly spaced to assure that a substantially axial flow of pulverized fuel and primary air is obtained within the transition region of the present fuel injector.

Another aspect of the present invention relates to an entire furnace which comprises a combustion chamber and a fuel injector as part of an overall burner system which provides a mixture of pulverized fuel and a carrier gas to be burned within the combustion chamber of the furnace. The fuel injector in accordance with this aspect of the present invention may include all or some of the features discussed above.

Yet another aspect of the present invention relates to a burner assembly system which may be used with a furnace. In accordance with this aspect of the present invention, a fuel injector may be provided as one component of the overall burner assembly system. The fuel injector may include all or some of the features discussed above.

Still another aspect of the present invention relates to a nozzle per se, which may be used with a fuel injector to transport pulverized fuel and a carrier gas to an associated furnace. In accordance with this aspect of the present invention, the nozzle can be used with various types of fuel injectors, some of which may not include an inner barrel. In accordance with this aspect of the present invention, the nozzle is preferably adapted to be connected to a distal end of a fuel injector for providing an outlet for the transported pulverized fuel and carrier gas. The nozzle may comprise an inlet side and an outlet side, and a continuous hollow body defining a continuous passageway extending between the inlet and outlet sides, said inlet side having a substantially circular hollow cross section and said outlet side having a hollow cross section defining a plurality of elliptical sections opening into the passageway, whereby the pulverized fuel and the carrier gas introduced into the passageway at the inlet side of the nozzle is forced to exit the nozzle through the elliptical sections at said outlet side so that separate fuel streams are obtained.

In accordance with this aspect of the present invention, the nozzle preferably comprises an inner surface and an outer surface. A plurality of secondary air straightening vanes may be arranged at the outer surface of the nozzle for preventing rotational components of secondary air flow adjacent the outer surface from prematurely forcing the separated fuel streams from merging together. The outer surface of the nozzle may also have convex sections which forms peaks and valleys associated with corresponding elliptical sections. Stabilizer vane means may be arranged at the peaks for maintaining each of the separated fuel streams close to the nozzle.

In one preferred embodiment of the present invention, the elliptical sections formed at the outlet side of the nozzle may comprise six equally spaced elliptical sections designed to produce six separated streams of pulverized fuel and primary air which exit the nozzle at the outlet side.

Accordingly, it is an object of the present invention to produce a fuel injector and a furnace which produces rich segmented streams of pulverized coal which has a particularly low $NO_x$ output upon combustion regardless of the shape or configuration of the open sections (i.e., elliptical sections) of the nozzle.

It is another object of the present invention to provide a fuel injector which can be inexpensively manufactured through investment casting.

It is still another object of the present invention to provide a fuel injector which overcomes problems often associated with coking of pulverized coal.

It is yet another object of the present invention to provide a fuel injector which has a very low pressure drop between the inlet and the nozzle thereof.

It is still a further object of the present invention to provide a fuel injector which substantially eliminates problems associated with roping of pulverized coal.

It is still a further object of the present invention to provide a pulverized fuel nozzle which can be utilized in conjunction with low $NO_x$ burner designs based on either single or dual secondary air registers for secondary air control.

It is still a further object of the present invention to provide a pulverized fuel nozzle which can be utilized in conjunction with fuel injectors of various configurations, including tangential scroll inlet designs for feeding annular fuel in primary air passageways, elbow inlet designs for feeding annular or pipe-type passageways, and ninety degree scroll inlet heads which feed annular or pipe-type passageways.

It is a more specific object of the present invention to provide a pulverized fuel nozzle which can be incorporated into a wide variety of low $NO_x$ burner designs and concepts by judicious adjustment of design parameters such as the nozzle diameter to length ratio, the quantity of elliptical segments arranged at the nozzle, and the ratio of the total area of the elliptical segments to the total nozzle area.

It is yet a further object of the present invention to provide a nozzle which can be connected to the distal end of various types of fuel injectors, some of which may include an inner barrel and an outer barrel while others may not include an inner barrel. It is therefore an object of the present invention to provide a nozzle which can be universally used with various types of fuel injectors for transporting pulverized fuel and primary air for combustion in an associated furnace.

These and other objects and advantages of the present invention will be more readily understood when considered in conjunction with the drawings and the detailed description of the preferred embodiments which follows.

FIG. S is a simplified schematic side sectional view of the fuel injector of the present invention illustrating fuel and air flow direction.

BRIEF DESCRIPTION OF THE PREFERRED EMBODIMENTS

Referring to FIGS. 1–5 of the drawings, the fuel injector 10 of the present invention is shown in isolated views and in assembled position in conjunction with a furnace 46.

Figure 1:
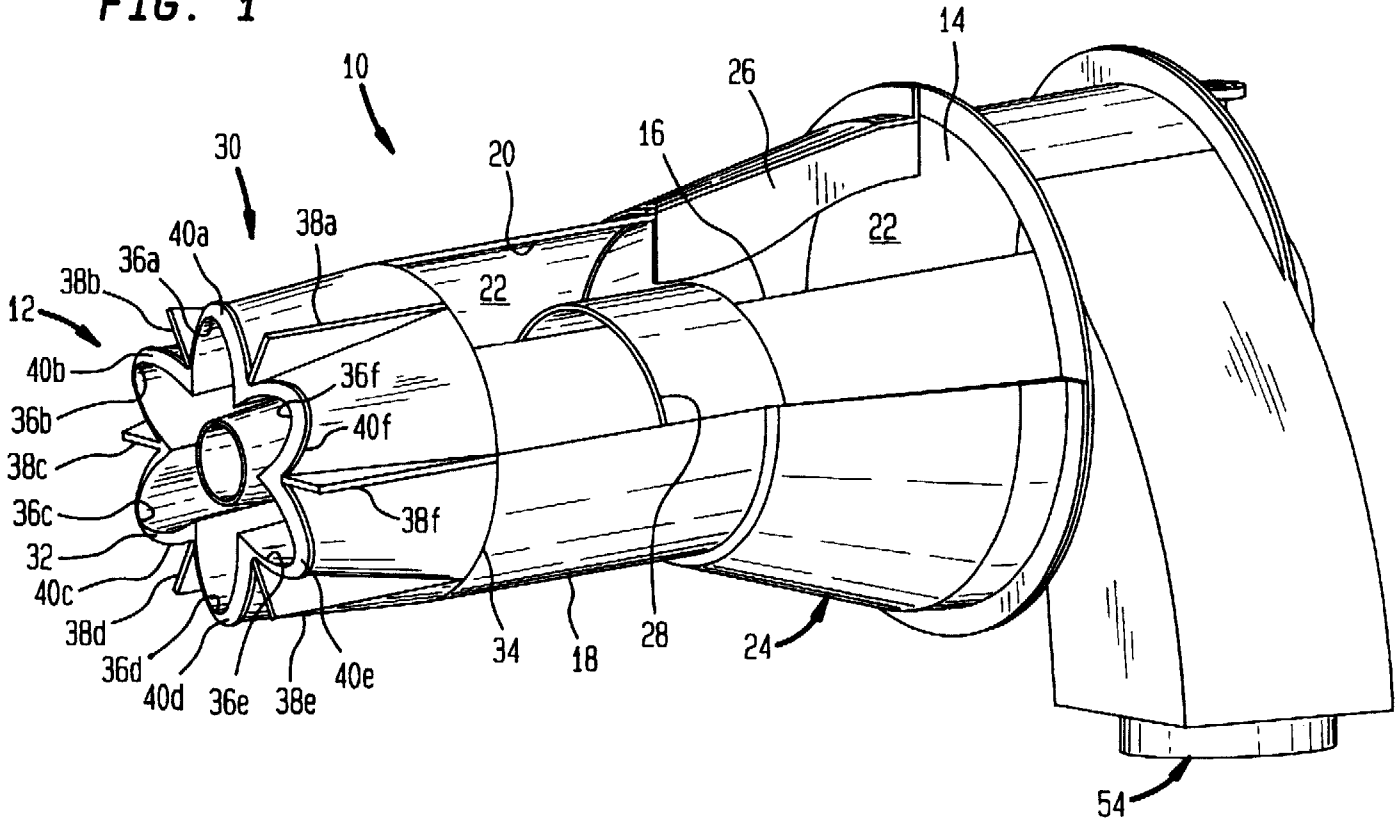
FIG. 1 is a perspective partially broken away view of the fuel injector of the present invention.
Figure 2:
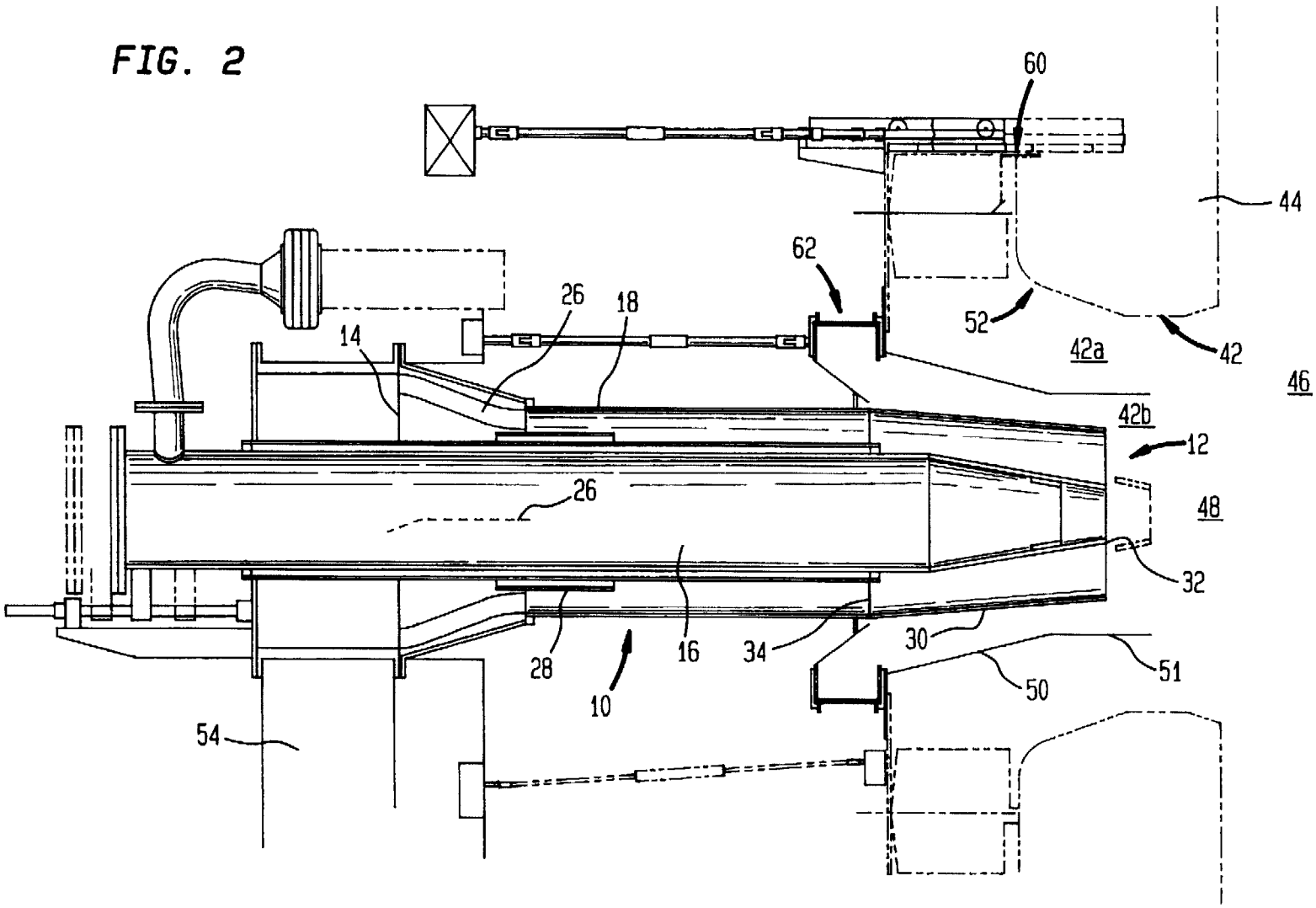
FIG. 2 is a cross-sectional longitudinal side view of the fuel injector of the present invention in conjunction with a furnace and related burner assembly components.

As clearly shown in FIGS. 1 and 2, the fuel injector 10 includes a distal end 12 and a proximal end 14. The fuel injector 10 is generally tapered from a relatively large diameter at the proximal-most end 14 (at the inlet) to a relatively small diameter at the distal-most end 12 (at the outlet). The materials of which the fuel injector 10 can be made are conventional and may include various materials capable of withstanding extreme heat, such as iron, various other metals, ceramic and the like.

As best shown in FIG. 2, the fuel injector 10 includes an elongated inner barrel 16 and an elongated outer barrel 18 which circumferentially surrounds the inner barrel 16 and extends substantially coaxially therewith.

An annular passage 22 is formed between the external surface of the inner barrel 16 and the inner wall 20 of the outer barrel 18. As win be discussed below, the annular passageway 22 is used as the flow path for delivering pulverized fuel, such as pulverized coal, and the carrier gas (i.e., primary air) to be consumed in a flame in the associated furnace 42.

A transition region 24 is arranged between the proximal end 14 and the distal end 12 of the fuel injector 10. The configuration of the transition region 24 is an important aspect of the fuel injector of the present invention. As illustrated in FIGS. 1 and 2, the transition region 24 includes a gradually tapered annular section which may include an S-like configuration. The functional aspect of the smooth S-shaped configuration of the transition region 24 is an improvement over prior art designs as it accomplishes rapid acceleration of the flow of pulverized coal and primary air above the "saltation" velocity (i.e., the velocity below which all of the transported fuel will no longer be in suspension) while reducing pressure losses which occur when the fuel stream and the primary air enters the annular passageway 22 of the fuel injector 10. This aspect of the present invention will be discussed further below.

A plurality of primary air straightening vanes 26 extend longitudinally at equally spaced intervals around the circumference of the inner wall surface 20 of the outer barrel 18 within the transition region 24. In a preferred embodiment of the present invention, six primary air straightening vanes 26 may be utilized to substantially eliminate any rotational component of the pulverized coal and primary air flow within the annular passageway 22 beyond the end of the transition region 24 proximate to the inlet.

An annular (i.e. cylindrical) deflector shield 28 at least partially surrounds the inner barrel 16 within the vicinity of the proximal-most end of the transition region 24. In a preferred embodiment, the deflector shield 28 entirely surrounds a portion of the inner barrel 16. The deflector shield 28 may be fixed to the external surface of the inner barrel 16. As will be discussed in connection with the operational aspects of the present invention, the deflector shield 28 serves as a splash plate which protects the surface of the inner barrel 16 from excessive wear which may otherwise occur due to direct impact of pulverized coal. The deflector shield 28 also serves to spread out the pulverized coal stream so that a uniform flow distribution of pulverized coal and primary air is transported to the body of a nozzle 30 at the distal end 12 of the fuel injector 10. Further, primary air which flows from the proximal end 14 to the distal end 12 of the fuel injector 10 along the surface of the inner barrel 16 will form a suspension cushion which uniformly distributes any pulverized coal which comes in contact therewith. Accordingly, the deflector shield 28 is also a particularly creative feature of the present fuel injector 10. However, it should be understood that although the deflector shield 28 is used in a preferred embodiment of the present fuel injector 10, it is an optional feature and is not necessary in all alternate embodiments which utilize the features of the present invention.

Figure 3:
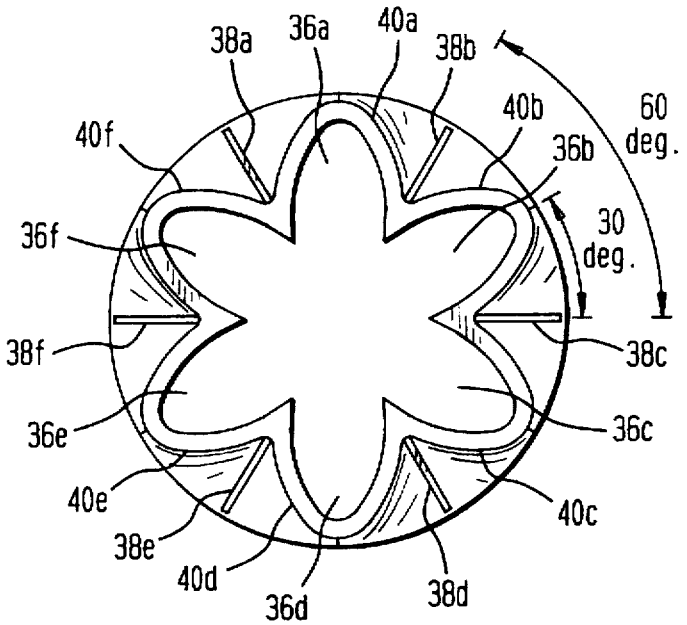
FIG. 3 is a front view of the nozzle of the fuel injector of the present invention.
Figure 4:
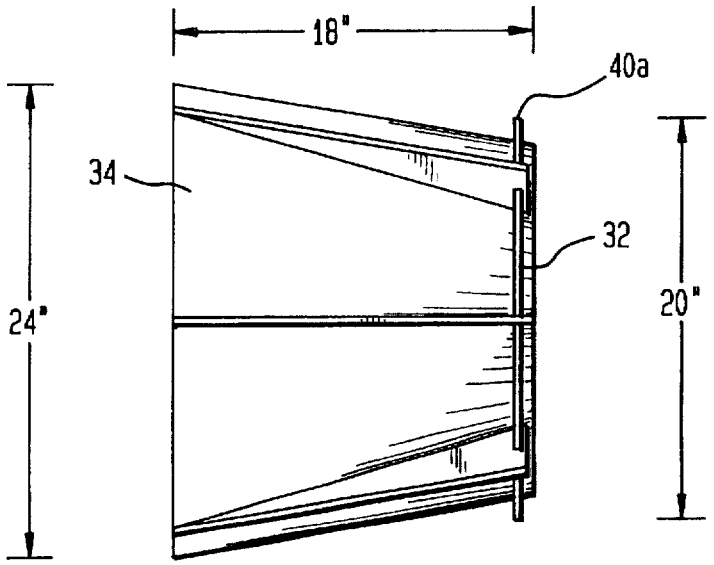
FIG. 4 is an isolated side view of the nozzle of the fuel injector of the present invention.

FIGS. 1, 3 and 4 clearly illustrate various novel features of the nozzle 30 of the fuel injector 10. The nozzle 30 is arranged at the distal end 12 of the fuel injector 10. In a preferred embodiment of the present invention, the nozzle 30 is integrally attached to the outer barrel 18 by various conventional techniques such as welding or bolting and the like. However, it should be appreciated that other techniques can be used to attach the nozzle 30 to the distal end 12 of the fuel injector 10.

The nozzle 30 includes a distal end 32, which is the distal-most end of the fuel injector 10, and a proximal end 34. As best shown in FIGS. 1 and 3, the distal end 32 of the nozzle includes a plurality of six elliptical sections having an inner surface designated by reference numerals 36A–F. It should be understood that the quantity of the elliptical sections can vary in alternate embodiments from two elliptical sections to more than eight elliptical sections. In particularly preferred embodiments of the present invention, the quantity of elliptical sections will vary between two and eight. The quantity of elliptical sections is determined by the desired flame length—the fewer the quantity of elliptical sections, the longer that the flame length will be. Thus, the fuel injector 10 which includes six elliptical sections would produce six streams which will have a shorter flame length than a nozzle which includes fewer than six elliptical sections. As discussed above, it should also be understood that the substantially elliptical configuration of the open sections of the nozzle is shown and described herein as an example of the preferred embodiment of the present invention, and that the term "elliptical sections" has been used herein for the purpose of describing the preferred embodiment of the present invention without restricting the scope of the claims to the preferred configuration.

As further illustrated in FIGS. 1 and 3, each of the elliptical sections include an open side diametrically opposing the respective inner surfaces 36A–F. The open side of the elliptical sections permit continuous fluid communication with the adjacent passageway 22 so the pulverized coal and primary air flowing therein will not be impeded within the nozzle 30.

The nozzle 30 is entirely open between its inlet portion (at its proximal end 34), which is preferably substantially circular in cross-section, and the outlet at the distal end 32 thereof, which includes the elliptical sections having inner surfaces 36A–F.

As illustrated in FIGS. 1, 2 and 4, the nozzle 30 is tapered from a relatively large diameter at its proximal end 34 to a relatively smaller diameter at its distal end 32. The degree of the taper in a preferred embodiment may be between one degree and fifteen degrees. However, alternate embodiments of the present invention may not include any taper whatsoever or may include nozzles having tapers substantially greater than fifteen degrees.

The particular size and configuration of the elliptical sections defined by inner surfaces 36A–F of the nozzle 30 may vary in alternate embodiments of the present invention. However, in a preferred embodiment, the geometric configuration of the elliptical sections may form an angle of approximately sixty degrees between consecutively arranged secondary air straightening vanes 38A–F. Further, in a typical arrangement, the distance extending between diametrically opposed inner surfaces of the elliptical sections, such as inner surfaces 36A and 36D) may be approximately twenty inches while the longitudinal length of the tapered nozzle 30 between its proximal end 34 and its distal end 32 may be approximately eighteen inches.

The inner surfaces 36A–F of the corresponding elliptical sections of the nozzle 30 preferably have a smooth curvature which is free from sharp angular surfaces or other discontinuities which would act to generate turbulence or recirculation zones into which pulverized coal particles can be drawn during operation where the fuel injector 10 is used to create a flame within an associated furnace. Thus, the nozzle 30 may be substantially free of coal layout or adhesion to the inner surfaces 36A–F of the elliptical sections. This aspect of the present invention will also be discussed further below.

Optional enhancements of the nozzle 30 are also illustrated in FIGS. 1, 3 and 4. Such optional enhancements include the use of secondary air straightening vanes 38A–F which extend longitudinally on the external surface of the nozzle 30 at valleys between the convex peaks formed by the elliptical sections of the nozzle. The secondary air straightening vanes 38A–F may minimize or entirely prevent any rotational component of secondary air flow from causing adjacent streams of pulverized coal and primary air from being prematurely merged together.

As also shown in FIGS. 1, 3 and 4, another optional enhancement includes stabilizer vanes 40A–F which extend around the outer periphery and circumference of each elliptical section at the distal-most end 32 of the nozzle 30. A small gap may be maintained between adjacent stabilizer vanes 40A–F to allow secondary air to pass toward the center axis of the nozzle 30. The independent stabilizer vanes 40A–F help assure that each of the flame streams formed from the separate elliptical sections of the nozzle 30 is well-rooted close the nozzle 30. Thus, maximum flame stability and minimum $NO_x$, CO and unburned carbon byproducts are produced.

With reference to FIG. 2, when the fuel injector 10 is arranged in assembled position, it extends within an opening 42 of a wall 44 of an otherwise conventional furnace 46. It should be understood that the furnace 46 will typically include various other openings to receive additional fuel injectors which may be identical to the fuel injector 10 of the present invention. It should also be understood that the furnace 46 may include conventional means for accommodating the flow of secondary air along the outer barrel 18 of fuel injector 10.

As best shown in FIG. 2, the fuel injector 10 is a single component of an entire burner assembly system associated with a corresponding furnace 46. It should be appreciated that the various additional components of the overall burner assembly system shown in FIG. 2 may vary in alternate embodiments of the present invention.

An annular air flow divider cone 50 may surround the nozzle 30 adjacent the opening 42 within the furnace wall 44. A bell mouth 52 may act as the outermost annular component which surrounds the air flow divider cone 50 as well as the nozzle 30 of the fuel injector 10. An adjustable sleeve damper 60 may be arranged between the bell mouth 52 and the air flow divider cone 50. An inner air control damper 62 is shown for controlling air flow between the outer barrel 18 in the vicinity of the nozzle 30 and the air flow divider cone 50. The inner air control damper 62 permits independent control of secondary air streams flowing to the two throat passages, 42A and 42B, formed between the opening 42, flow divider extension 51 and nozzle 30.

Figure 5:
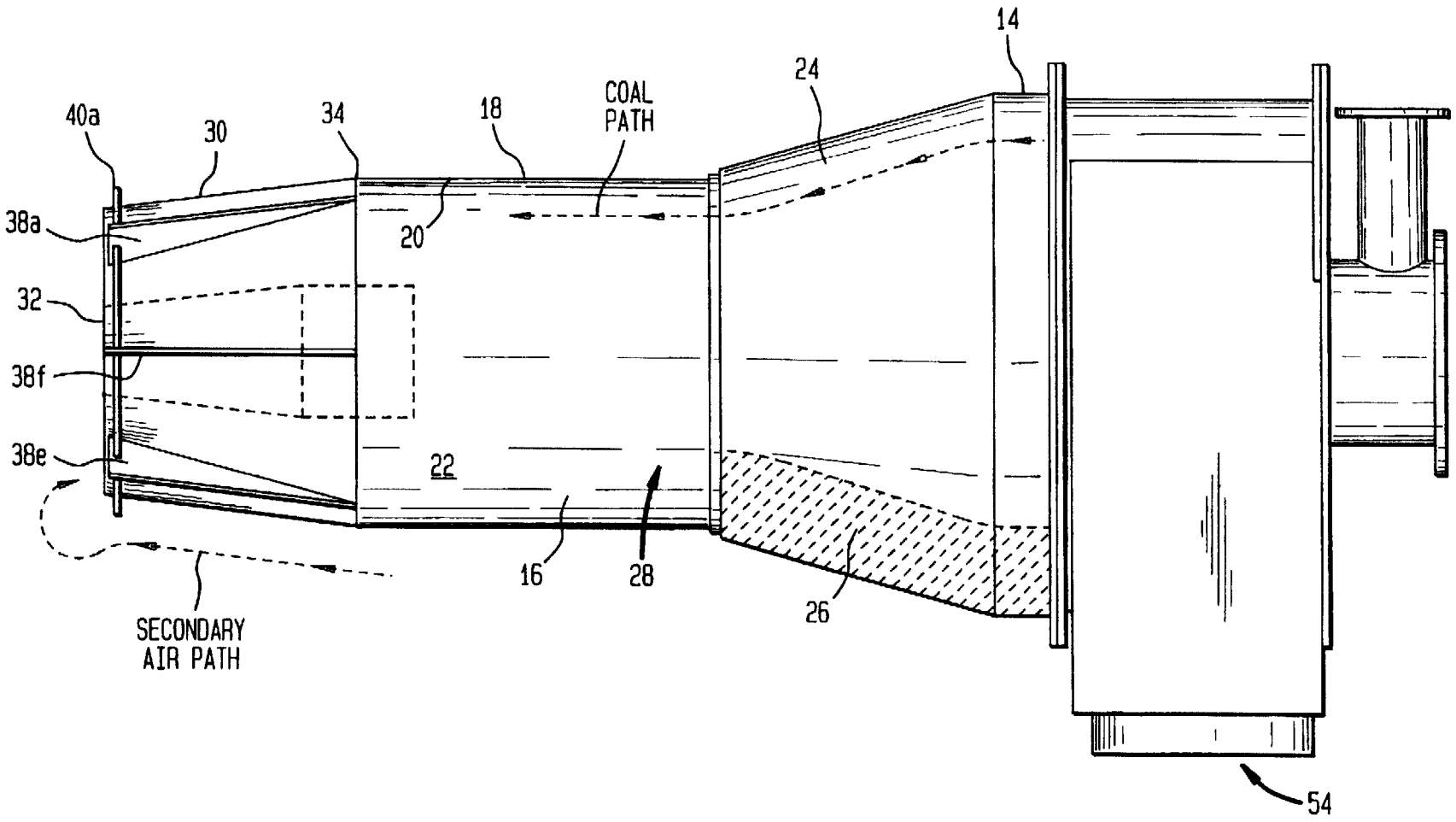

An inlet feed 54 is arranged at the proximal end 14 of the fuel injector 10 for transporting pulverized coal and primary air into the passageway 22 between the inner wall 20 of the outer barrel 18 and the inner barrel 16. The flow path of the pulverized coal and primary air within the passageway 22 is illustrated in FIG. 5. The flow path of secondary air along the external surface of the outer barrel 18 is also illustrated in FIG. 5.

When the pulverized coal and primary air stream is initially introduced into the passageway 22 through the inlet feed 54, the stream is directed along a transverse flow path which would tend to circle about the inner barrel 16. However, it is desirable for the stream of pulverized coal and primary air to flow only in the axial direction through passageway 22 so that coal layout on the surface of inner barrel 16 and on the bottom of outer barrel 18 at the inner wall 20 thereof is minimized. As discussed above, problems associated with coal layout existed in prior art scroll inlet designs because when pulverized coal is suspended or entrained within a source of primary air, and a rotational or tangential velocity is applied, as from a tangential scroll inlet, the coal particles will tend to move radially outward of the stream toward the inner wall 20 of the outer barrel 18 since such coal particles are heavier than the carrier air and centrifugal forces are applied thereto. As a result, prior art scroll inlet fuel injectors were prone to the substantial problem of coking at the central region of the fuel injector. Further, prior art fuel injectors were prone to coking problems at the nozzle due to turbulent eddy zones within split-stream ports which therefore caused coal adhesion to the nozzle surface. These problems have been eliminated by the aforementioned design of the fuel injector 10 so that coal layout is virtually nonexistent.

As the pulverized coal and primary air enter into the passageway 22, any rotational components of the flow stream are converted into axial components within the transition region 24 by the primary air straightening vanes 26. The primary air straightening vanes 26 also serve the function of creating six separated streams of pulverized coal and primary air within the passageway 22. Further, since the transition region 24 of the fuel injector 10 smoothly tapers the outer barrel 18 from a relatively large diameter to a relatively small diameter, the velocity of the pulverized coal and primary air is substantially increased while the pressure drop is minimized. As the stream of pulverized coal and primary air passes the proximal end of the primary air straightening vanes 26 within the transition region 24, it impacts upon the annular deflector shield 28 thus protecting the surface of the inner barrel 16 from excessive wear due to the impact of pulverized coal particles. The deflector shield 28 thus acts as a splash plate which spreads out the impacting stream of pulverized coal so that a uniform coal flow distribution is transported to the distal end 32 of the nozzle 30. Further, primary air flow between the inner barrel 16 and the deflector shield 28 forms a suspension cushion adjacent the external surface of the inner barrel which helps create the uniform flow of pulverized coal within the passageway 22.

As the pulverized coal and primary air continue to flow toward the nozzle 30, there are substantially no rotational flow components that remain. The pulverized coal and primary air flow is then transported past the proximal end 34 of the nozzle 30 where the inlet has a substantially circular cross-sectional opening. The streams are separated by the elliptical sections as they become concentrated along the inner surfaces 36A–F. The result is six particularly rich concentrated streams of pulverized coal which are further supported by the secondary air which flows along the external surface of outer barrel 18 while the fuel stream burns within the combustion chamber 48 of the furnace 46.

As illustrated in FIG. 5, the stabilizer vanes 40A–F are impacted by the secondary air flowing along the outer barrel 18 so that eddy flows are created which preclude substantial interference with the primary pulverized coal stream while still facilitating enhancement of the resulting flame.

It should be appreciated that the various inventive features of the present fuel injector 10 discussed herein can be used as part of a fuel injector design independently of each other while still providing substantial enhancements within the burner assembly field. Further, the use of these novel, unobvious and improved features optimize performance of the present fuel injector 10 while eliminating many problems associated with prior art fuel injectors and overall burner assembly systems.

It should be appreciated that various modifications to the configuration and size of the present fuel injector 10 may be made to the preferred embodiments of the present invention without departing from the scope of the present invention as defined in the claims set forth below.

I claim:

1. A fuel injector for use in a furnace, said fuel injector comprising:

an elongated inner barrel; and an elongated outer barrel having an inlet end and an outlet end, mid outer barrel extending coaxially with and circumferentially surrounding said inner barrel between said inlet and outlet ends defining an elongated passageway between said inner and outer barrels, said passageway adapted to accommodate the flow of pulverized fuel and a carrier gas therein, said outlet end including a nozzle having a plurality of open sections, each of said open sections opening into said passageway, whereby the pulverized fuel and the carrier gas introduced into said passageway at said inlet end of said outer barrel is forced to exit said fuel injector through said open sections of said nozzle so that separate fuel streams are obtained.

2. The fuel injector of claim I wherein said outer barrel comprises a transition region arranged between said inlet and outlet ends, said transition region being tapered to decrease the diameter of said outer barrel as it extends between said inlet and outlet ends, whereby the velocity at which said pulverized fuel and said carrier gas flows within said passageway is increased.

3. The fuel-injector of claim 2 further comprising a cylindrical deflector shield at least partially surrounding said inner barrel at distal end of said transition region proximate to said outlet end, whereby said deflector shield is adapted to protect said inner barrel from wear due to the impact of pulverized fuel particles and to spread out impacting pulverized fuel so that are substantially) uniform flow distribution of the pulverized fuel is obtained as said pulverized fuel and carrier gas exit said transition region and flow toward said nozzle.

4. The fuel injector of claim 1 wherein said nozzle comprises an inner surface and an outer surface, and stabilizer vane means arranged at the outer surface of the distal-most portion of said outlet end for maintaining each of said separated fuel streams in close proximity to said nozzle.

5. The fuel injector of claim 1 wherein said nozzle comprises an inner surface and an outer surface, said outer surface of said nozzle having convex sections forming peaks and valleys, and secondary air straightening vane means arranged at aid valleys for preventing rotational components of secondary air flow adjacent said outer surface of said nozzle from prematurely forcing the separated fuel streams from emerging together.

6. The fuel injector of claim 1 further comprising a deflector shield at least partially surrounding said inner barrel between said inlet and outlet ends of said outer barrel.

7. An the fuel injector of claim 1 wherein said outer barrel includes a relatively large diameter at said inlet end and a relatively small diameter at said outlet end.

8. The fuel injector of claim 1 wherein said plurality of open sections of said nozzle comprise an elliptical configuration.

9. A fuel injector for use in a furnace, said fuel injector comprising:

an elongated inner barrel; and an elongated outer barrel having an inlet end and an outlet end, said outer barrel extending coaxially with and circumferentially surrounding said inner barrel between said inlet and outlet ends defining an elongated passageway between said inner and outer barrels, said passageway adapted to accommodate the flow of pulverized fuel and a carrier gas therein, said outer barrel having a relatively large diameter at said inlet end and a relatively small diameter at said outlet end, said outer barrel including a transition region arranged between said inlet and outlet ends, said transition region being tapered to decrease the diameter of said outer barrel from said relatively large diameter to said relatively small diameter as it extends between said inlet and outlet ends, said transition region having an inner surface and a plurality of elongated primary air straightening vanes arranged on said inner surface for converging, rotational flow of pulverized fuel and primary air about said inner barrel into an axial flow stream.

10. The fuel injector of claim 9 further comprising a cylindrical deflector shield at least partially surrounding said inner barrel at a distal end of said transition region proximate to said outlet end, whereby said deflector shield is adapted to protect said inner barrel from wear due to the impact of pulverized fuel particles and to spread out impacting pulverized fuel so that a uniform flow distribution of the pulverized fuel is obtained as said pulverized fuel and carrier gas exit said transition region and flow toward said nozzle.

11. The fuel injector of claim 9 wherein said outer barrel further includes a nozzle having a plurality of open sections each of said open sections opening into said passageway, whereby the pulverized fuel and the carrier gas introduced into said passageway at said inlet end of said outer barrel proceeds substantially uninterrupted without encountering any barrier and are forced to exit said fuel injector through said open sections of said nozzle so that separated fuel streams are obtained, said nozzle including an inner surface and an outer surface, and stabilizer vane means arranged at the outer side of the distal-most portion of said outlet end for maintaining each of said separated fuel streams in close proximity to said nozzle.

12. The fuel injector of claim 11, wherein said plurality of open sections of said nozzle comprise an elliptical configuration.

13. The fuel injector of claim 9 wherein said outer barrel further includes a nozzle having plurality of open sections each of said open sections opening into said passageway, whereby the pulverized fuel and the carrier gas introduced into said passageway at said inlet end of said outer barrel proceeds substantially uninterrupted without encountering any barrier and are forced to exit said fuel injector through said open sections of said nozzle so that separated fuel streams are obtained, said nozzle including an inner surface and an outer surface , said outer surface of said nozzle having convex sections forming peaks and valleys, and secondary air straightening vane means arranged at said valleys for preventing rotational components of secondary air flow adjacent said outer side of said nozzle from prematurely forcing the separated fuel streams from merging together.

14. The fuel injector of claim 9 further comprising a deflector shield at least partially surrounding said inner barrel between said inlet and outlet ends of said outer barrel.

15. A furnace comprising;

a combustion chamber; and a fuel injector for providing a mixture of pulverizing fuel and a carrier gas to be burned in said combustion chamber, said fuel injector including, an elongated inner barrel; and an elongated outer barrel having an inlet end and an outlet end, said outer barrel extending coaxially with and circumferentially surrounding said inner barrel between said inlet and outlet ends defining an elongated passageway between said inner and outer barrels, said passageway adapted to accommodate the flow of pulverized fuel and a carrier gas therein, said outer barrel including a transition region arranged between said outer barrel as it extends between said inlet and outlet ends, said transition region having an inner surface with an s-shaped configuration whereby rapid acceleration of the flow of the pulverized fuel and the carrier gas is obtained.

16. The furnace of claim 15 wherein said nozzle comprises an inner surface and an outer surface, and stabilizer vane means arranged at the outer surface of the distal-most portion of said outlet end for maintaining each of said separated fuel streams in close proximity to said nozzle.

17. The furnace of claim 15 wherein said nozzle comprises an inner surface and an outer surface, said outer surface of said nozzle having convex sections forming hills and valleys, and secondary air straightening vane means arranged at said valleys for preventing rotational components of secondary air flow adjacent said outer surface of said nozzle from prematurely forcing the separated fuel streams from merging together.

18. The furnace of claim 15 further comprising a deflector shield at least partially surrounding said inner barrel between said inlet and outlet ends of said outer barrel.

19. The furnace of claim 15 further comprising a cylindrical deflector shield at least partially surrounding said inner barrel at the end of said transition region proximate to said outlet end, whereby said deflector shield is adapted to protect said inner barrel from wear due to impact of pulverized fuel particles and to spread out impacting pulverized fuel so that a uniform flow distribution of the pulverized fuel is obtained as said pulverized fuel and carrier gas exit said transition region and flow toward said nozzle.

20. The furnace of claim 15 wherein said outer barrel includes a relatively large diameter at said inlet end and a relatively small diameter at said outlet end.

21. The furnace of claim 15 wherein said plurality of open sections of said nozzle comprise an elliptical configuration.

22. A burner assembly system for use with furnace, said burner assembly system comprising a fuel injector for providing a mixture of pulverized fuel and a carrier gas to be burned in a combination chamber of said furnace, said fuel injector including, an elongated inner barrel; and an elongated outer barrel having an inlet end and an outlet end, said outer barrel coaxially with and circumferentially surrounding said inner barrel between said inlet and outlet ends defining an elongated passageway between said inner and outer barrels, said passageway adapted to accommodate the flow of pulverized fuel and a carrier gas therein, said outer barrel including a transition region arranged between said inlet and outlet ends; said transition region being tapered to decrease the diameter of said outer barrel as it extends between said inlet and outlet ends, said transition region having an inner surface with an s-shaped configuration whereby rapid acceleration of the flow of the pulverized fuel and the carrier gas is obtained.

23. The burner assembly of claim 22 wherein said plurality of open sections of said nozzle comprise an elliptical configuration.

24. A nozzle for use with a fuel transport pulverized fuels and a carrier gas to an associated furnace, said nozzle being adapted to be connected to a distal end of a fuel injector having an inner barrel and an outer barrel extending coaxially with and circumferentially surrounding said inner barrel, said nozzle providing an outlet for the transported pulverized fuel and carrier gas, said nozzle comprising an inlet side and an outlet side, and a continuous hollow body defining a continuous passageway extending between and the inlet and outlet sides, said inlet side having a substantially circular hollow cross section and said outlet side having a hollow cross section defining a plurality of open sections opening into said passageway, whereby the pulverized fuel and the carrier gas introduces into said passageway at said inlet side of said nozzle is forced to exit said nozzle through said open sections at said outlet side so that separate fuel streams are obtained.

25. The nozzle of claim 24 further comprising an inner surface and an outer surface, and stabilizer vane means arranged at the outer surface of said outlet side for maintaining each of said separated fuel streams in close proximity to said nozzle.

26. The nozzle of claim 24 comprising an inner surface and an outer surface, said outer surface of said nozzle having convex sections forming peaks and valleys, and secondary air straightening vane means arranged at said valleys for preventing rotational components of secondary air flow adjacent said outer surface of said nozzle from prematurely forcing the separated fuel streams from merging together.

27. The nozzle of claim 24 wherein said plurality of open sections comprises six open sections.

28. The nozzle of claim 24 wherein said plurality of open sections of said nozzle comprise an elliptical configuration.

29. A fuel injector for use in a furnace, said injector comprising:

an elongated inner barrel; and an elongated outer barrel having an inlet end and an outlet end, said outer barrel extending coaxially with and circumferentially surrounding said inner barrel between said inlet and outlet ends, said transition region being tapered and having an inner surface with an s-shaped configuration so that rapid acceleration of the flow of pulverized fuel and carrier gas is obtained.

30. The fuel injector of claim 29 wherein said outer barrel further comprises a nozzle having a plurality of open sections, each of said open sections opening into said passageway whereby the pulverized fuel and the carrier gas introduced into said passageway at said inlet end of said outer barrel are forced to exit said fuel injector through said open sections of said nozzle so that separated fuel streams are obtained.

31. The fuel injector of claim 29 further comprising a cylindrical deflector shield at least partially surrounding said inner barrel at a distal end of said transition region proximate to said outlet end, whereby said deflector shield is adapted to protect said inner barrel from wear due to the impact of pulverized fuel particles and to spread out impacting pulverized fuel so that a uniform flow distribution of the pulverized fuel is obtained as said pulverized fuel and carrier gas exit said transition region and flow toward said nozzle.

32. A fuel injector for use in a furnace, said fuel injector compromising:

an elongated inner barrel;

an elongated outer barrel having an inlet end and an outlet end, said outer barrel extending coaxially with and circumferentially surrounding said inner barrel between said inlet and outlet ends defining an elongated passageway between said inner and outer barrels, said passageway adapted to accommodate the flow of pulverized fuel and a carrier gas therein, said outer barrel having a relatively large diameter at said inlet end and a relatively small diameter at said outlet end, said outer barrel including a transition region arranged between said inlet and outlet ends, said transition region being tapered to decrease the diameter as it extends between said inlet and outlet ends, said outlet end including a nozzle having a plurality of open sections opening into said passageway; and a deflector shield at least partially surrounding said inner barrel at a distal end of said transition region proximate to said outlet end, whereby said deflector shield is adapted to spread out impacting pulverized fuel so that a uniform flow distribution of the pulverized fuel is obtained as said pulverized fuel and carrier gas exit said transition region and flow toward said nozzle.

33. The fuel injector of claim 32 wherein said deflector shield has a cylindrical configuration and is adapted to protect said inner barrel from wear which would otherwise occur due to the impact of pulverized fuel particles.

* * * * *

UNITED STATES PATENT AND TRADEMARK OFFICE

CERTIFICATE OF CORRECTION

PATENT NO. : 5,762,007

DATED : June 9, 1998

INVENTOR(S) : Vatsky

It is certified that error appears in the above-identified patent and that said Letters Patent is hereby corrected as shown below:

Column 1, line 22, "$NO_X$" should read --$NO_X$--.

Column 6, line 31, "FIG. S" should read --FIG. 5--.

Column 6, line 56, "win" should read --will--.

Column 11, line 2, "mid" should read --said--.

Column 11, line 15, "I" should read --1--.

Column 11, line 22, "fuel-injector" should read --fuel injector--.

Column 11, line 24, "at distal" should read --at a distal--.

Column 11, line 28, "that are substantially) uniform"
should read --that a uniform--.

Column 11, line 41, "aid" should read --said--.

Column 11, line 44, "emerging" should read --merging--.

Column 11, line 48, "An the" should read --The--.

Column 12, line7, "converging," should read --converting--.

Column 12, line 67 - Column 13, line 1, "said outer" should read --said inlet and outlet ends, said transition region being tapered to decrease the diameter of said--.

UNITED STATES PATENT AND TRADEMARK OFFICE

CERTIFICATE OF CORRECTION

PATENT NO. : 5,762,007

DATED : June 9, 1998

INVENTOR(S) : Vatsky

It is certified that error appears in the above-identified patent and that said Letters Patent is hereby corrected as shown below:

Column 13, line 59 "fuel transport pulverized fuels" should read --fuel injector to transport pulverized fuel--.

Column 13, line 67, Column 14, line 1 "between and the" should read --between the--.

Column 14, line 5, "introduces" should read --introduced--.

Column 14, line 14, "24 comprising" should read --24 further comprising--.

Column 14, line 25, "said injector" should read --said fuel injector--.

Column 14, line 53, "compromising" should read --comprising--.

Column 14, line 66, "diameter as" should read --diameter of said outer barrel from said relatively large diameter to said relatively small diameter as--.

Signed and Sealed this

First Day of September, 1998

*Attest:*

*Attesting Officer*

BRUCE LEHMAN

*Commissioner of Patents and Trademarks*